US011503406B2

(12) United States Patent
Fujii et al.

(10) Patent No.: US 11,503,406 B2
(45) Date of Patent: Nov. 15, 2022

(54) PROCESSOR, OUT-OF-HEAD LOCALIZATION FILTER GENERATION METHOD, AND PROGRAM

(71) Applicant: JVCKENWOOD Corporation, Yokohama (JP)

(72) Inventors: Yumi Fujii, Yokohama (JP); Hisako Murata, Yokohama (JP); Kuniaki Takachi, Yokohama (JP); Takahiro Gejo, Yokohama (JP); Mayo Iiyama, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/378,590

(22) Filed: Jul. 16, 2021

(65) Prior Publication Data

US 2022/0021973 A1 Jan. 20, 2022

(30) Foreign Application Priority Data

Jul. 20, 2020 (JP) ..... JP2020-123655

(51) Int. Cl.
*H04R 3/04* (2006.01)
*H04R 5/033* (2006.01)
*H04R 5/04* (2006.01)

(52) U.S. Cl.
CPC ..... *H04R 3/04* (2013.01); *H04R 5/033* (2013.01); *H04R 5/04* (2013.01)

(58) Field of Classification Search
None
See application file for complete search history.

(56) References Cited

U.S. PATENT DOCUMENTS

2017/0332186 A1* 11/2017 Riggs ..... H04S 7/301
2019/0246217 A1* 8/2019 Miller ..... H04R 3/02
(Continued)

FOREIGN PATENT DOCUMENTS

JP 2018133708 A 8/2018
JP 2018191208 A 11/2018

OTHER PUBLICATIONS

Yoshida, Masataka, et al. "Implementation of DSP-based Adaptive Inverse Filtering System for ECTF Equalization." AES Convention Paper 7690, May 2009. (Year: 2009).*

*Primary Examiner* — James K Mooney
(74) *Attorney, Agent, or Firm* — Procopio, Cory, Hargreaves & Savitch LLP

(57) ABSTRACT

A processor, an out-of-head localization filter generation method, and a program capable of performing appropriate processing are provided. An out-of-head localization filter determination device according to this embodiment includes a built-in microphone embedded in an output unit, a measurement unit configured to output a measurement signal to the output unit and measure a sound pickup signal output from the built-in microphone, a frequency characteristics acquisition unit configured to convert the sound pickup signal into a frequency domain and acquire first frequency characteristics, a conversion unit configured to convert the first frequency characteristics into second frequency characteristics by applying a representative conversion function to the first frequency characteristics, and an inverse filter calculation unit configured to calculate an inverse filter based on the second frequency characteristics.

6 Claims, 11 Drawing Sheets

(56) References Cited

U.S. PATENT DOCUMENTS

| | | | | |
|---|---|---|---|---|
| 2019/0373385 | A1 | 12/2019 | Uchida et al. | |
| 2020/0068337 | A1* | 2/2020 | Murata | H04R 5/04 |
| 2021/0393168 | A1* | 12/2021 | Santarelli | A61B 5/1171 |

* cited by examiner

| ID OF PERSON BEING MEASURED | LEFT/ RIGHT | FIRST PRESET DATA | SECOND PRESET DATA |
|---|---|---|---|
| | | FIRST EAR CANAL TRANSFER CHARACTERISTICS | SECOND EAR CANAL TRANSFER CHARACTERISTICS |
| ID_A | L | AL_bim | AL_Stetho |
| ID_A | R | AR_bim | AR_Stetho |
| ID_B | L | BL_bim | BL_Stetho |
| ID_B | R | BR_bim | BR_Stetho |
| ⋮ | ⋮ | ⋮ | ⋮ |

Fig. 8

| CLUSTER | REPRESENTATIVE CHARACTERISTICS | REPRESENTATIVE CONVERSION FUNCTION |
|---|---|---|
| 1 | 1_bim | 1_CONV |
| 2 | 2_bim | 2_CONV |
| ⋮ | ⋮ | ⋮ |
| k | k_bim | k_CONV |

Fig. 9

PROCESSOR, OUT-OF-HEAD LOCALIZATION FILTER GENERATION METHOD, AND PROGRAM

CROSS REFERENCE TO RELATED APPLICATION

This application is based upon and claims the benefit of priority from Japanese patent application No. 2020-123655, filed on Jul. 20, 2020, the disclosure of which is incorporated herein in its entirety by reference.

BACKGROUND

The present disclosure relates to a processor, an out-of-head localization filter generation method, and a program.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones placed on the listener (user)'s ears. Then, a processor generates a filter based on a sound pickup signal obtained by impulse response. Accordingly, a filter in accordance with spatial acoustic transfer characteristics from the speakers to the ear canal where the microphones are placed is generated. The generated filter is convolved to 2-ch audio signals, thereby implementing out-of-head localization reproduction.

Further, in order to generate a filter for canceling out characteristics from headphones to ears, characteristics from the headphones to a part near the ear or to an eardrum (ear canal transfer function ECTF; also referred to as ear canal transfer characteristics) are measured by microphones worn on listener's ears.

Japanese Unexamined Patent Application Publication No. 2018-191208 discloses an out-of-head localization filter determination device including headphones and a microphone unit. In Japanese Unexamined Patent Application Publication No. 2018-191208, a server device stores first preset data related to spatial acoustic transfer characteristics from a sound source to an ear of a person being measured and second preset data related to ear canal transfer characteristics of the ear of the person being measured in association with each other. A user terminal measures measurement data related to the ear canal transfer characteristics of the user. The user terminal transmits user data based on measurement data to the server device. The server device compares the user data with the plurality of pieces of second preset data. The server device extracts first preset data based on the comparison result.

Japanese Unexamined Patent Application Publication No. 2018-133708 discloses a sound pickup device capable of picking up measurement signals from headphones at an appropriate sound pickup position. For example, Japanese Unexamined Patent Application Publication No. 2018-133708 discloses the sound pickup device having a stethoscope-like structure.

When out-of-head localization processing is performed, characteristics are preferably measured by microphones placed on the listener's ears. Impulse response measurement (which is also referred to as "user measurement") and the like are executed in a state in which microphones are worn on the listener's ears. By using characteristics of the listener himself/herself, it is possible to generate a filter suitable for the listener.

That is, by performing user measurement, it is possible to appropriately measure the spatial acoustic transfer characteristics from the speaker to the ear canal. However, in order to perform user measurement, the user needs to go to a listening room or arrange a listening room at his/her home.

In the method disclosed in Japanese Unexamined Patent Application Publication No. 2018-191208, first preset data related to spatial acoustic transfer characteristics and second preset data related to ear canal transfer characteristics are associated with each other in a database. Then spatial acoustic transfer characteristics suitable for a user are extracted from the first preset data based on the ear canal transfer characteristics of an individual user. According to the method disclosed in Japanese Unexamined Patent Application Publication No. 2018-191208, it is possible to determine a filter without performing the user measurement of the spatial acoustic transfer characteristics.

It has been required to determine a filter for performing out-of-head localization processing more appropriately.

SUMMARY

A processor according to this embodiment includes: an output unit configured to be worn on a person being measured and output sounds to an ear of the person being measured; a built-in microphone embedded in the output unit; an independent microphone provided independently from the output unit; a measurement processor unit configured to output a measurement signal to the output unit and measure a sound pickup signal output from the built-in microphone or an independent microphone; a frequency characteristics acquisition unit configured to acquire each of frequency characteristics of first ear canal transfer characteristics acquired using the built-in microphone and frequency characteristics of second ear canal transfer characteristics acquired in a state in which the independent microphone is worn on the person being measured; a conversion function calculation unit configured to calculate a conversion function between the frequency characteristics of the first ear canal transfer characteristics and the frequency characteristics of the second ear canal transfer characteristics; a clustering unit configured to cluster a plurality of persons being measured based on conversion functions of a plurality of persons being measured; a representative characteristics calculation unit configured to calculate representative characteristics for each cluster based on the plurality of first ear canal transfer characteristics that belong to a cluster; and a representative conversion function calculation unit configured to calculate a representative conversion function for each cluster based on the plurality of conversion functions that belong to the cluster.

An out-of-head localization filter generation method according to this embodiment in a method in a system. The system includes: an output unit configured to be worn on a user and output sounds to an ear of the user; a built-in microphone embedded in the output unit; a data storage unit configured to store first preset data related to first ear canal transfer characteristics picked up by a built-in microphone embedded in the output unit and second preset data related to second ear canal transfer characteristics acquired in a state in which a person being measured wears an independent microphone that is independent from the output unit in association with each other, the data storage unit storing a plurality of first and second preset data acquired for a plurality of persons being measured. In the data storage unit, the first and second preset data are clustered based on a conversion function between the first ear canal transfer characteristics and the second ear canal transfer characteristics, representative characteristics are calculated for each of clusters based on a plurality of first ear canal transfer characteristics that belong to a cluster, a representative conversion function is calculated for each cluster based on the plurality of conversion functions that belong to the cluster. The out-of-head localization filter generation method includes: an output step for outputting a measurement signal to each output unit worn on the user; a signal acquisition step for acquiring a sound pickup signal when the measurement signal output from the output unit toward the user's ear is picked up by a microphone unit worn on the ear of the user; a first frequency characteristics acquisition step for converting the sound pickup signal into a frequency domain and acquiring first frequency characteristics; a comparing step for comparing the first frequency characteristics with a plurality of representative characteristics; an extraction step for extracting the representative conversion function based on a comparison result in the comparing step; a second frequency characteristics calculation step for calculating second frequency characteristics by applying the extracted representative conversion function to the first frequency characteristics; and an inverse filter calculation step for calculating an inverse filter based on the second frequency characteristics.

A program according to this embodiment is a program for causing a computer to execute an out-of-head localization filter generation method, in which the computer is able to access a data storage unit configured to store first preset data related to first ear canal transfer characteristics picked up by a built-in microphone embedded in an output unit and second preset data related to second ear canal transfer characteristics acquired in a state in which a person being measured wears an independent microphone that is independent from the output unit in association with each other, the data storage unit storing a plurality of first and second preset data acquired for a plurality of persons being measured, in the data storage unit, the first and second preset data are clustered based on a conversion function between the first ear canal transfer characteristics and the second ear canal transfer characteristics, representative characteristics are calculated for each of clusters based on a plurality of first ear canal transfer characteristics that belong to a cluster, a representative conversion function is calculated for each cluster based on the plurality of conversion functions that belong to the cluster, and the out-of-head localization filter generation method includes: an output step for outputting a measurement signal to each output unit worn on the user; a signal acquisition step for acquiring a sound pickup signal when the measurement signal output from the output unit toward the user's ear is picked up by a microphone unit worn on the ear of the user; a first frequency characteristics acquisition step for converting the sound pickup signal into a frequency domain and acquiring first frequency characteristics; a comparing step for comparing the first frequency characteristics with a plurality of representative characteristics; an extraction step for extracting the representative conversion function based on a comparison result in the comparing step; a second frequency characteristics calculation step for calculating second frequency characteristics by applying the extracted representative conversion function to the first frequency characteristics; and an inverse filter calculation step for calculating an inverse filter based on the second frequency characteristics.

According to the present disclosure, it is possible to provide an out-of-head localization filter generation system, a processor, an out-of-head localization filter generation method, and a program capable of appropriately generating a filter.

BRIEF DESCRIPTION OF THE DRAWINGS

The above and other aspects, advantages and features will be more apparent from the following description of certain embodiments taken in conjunction with the accompanying drawings, in which:

FIG. 8 is a table for describing first and second preset data stored in a data storage unit;

FIG. 9 is a table for describing clustered data;

DETAILED DESCRIPTION (Overview)

Figure 1:
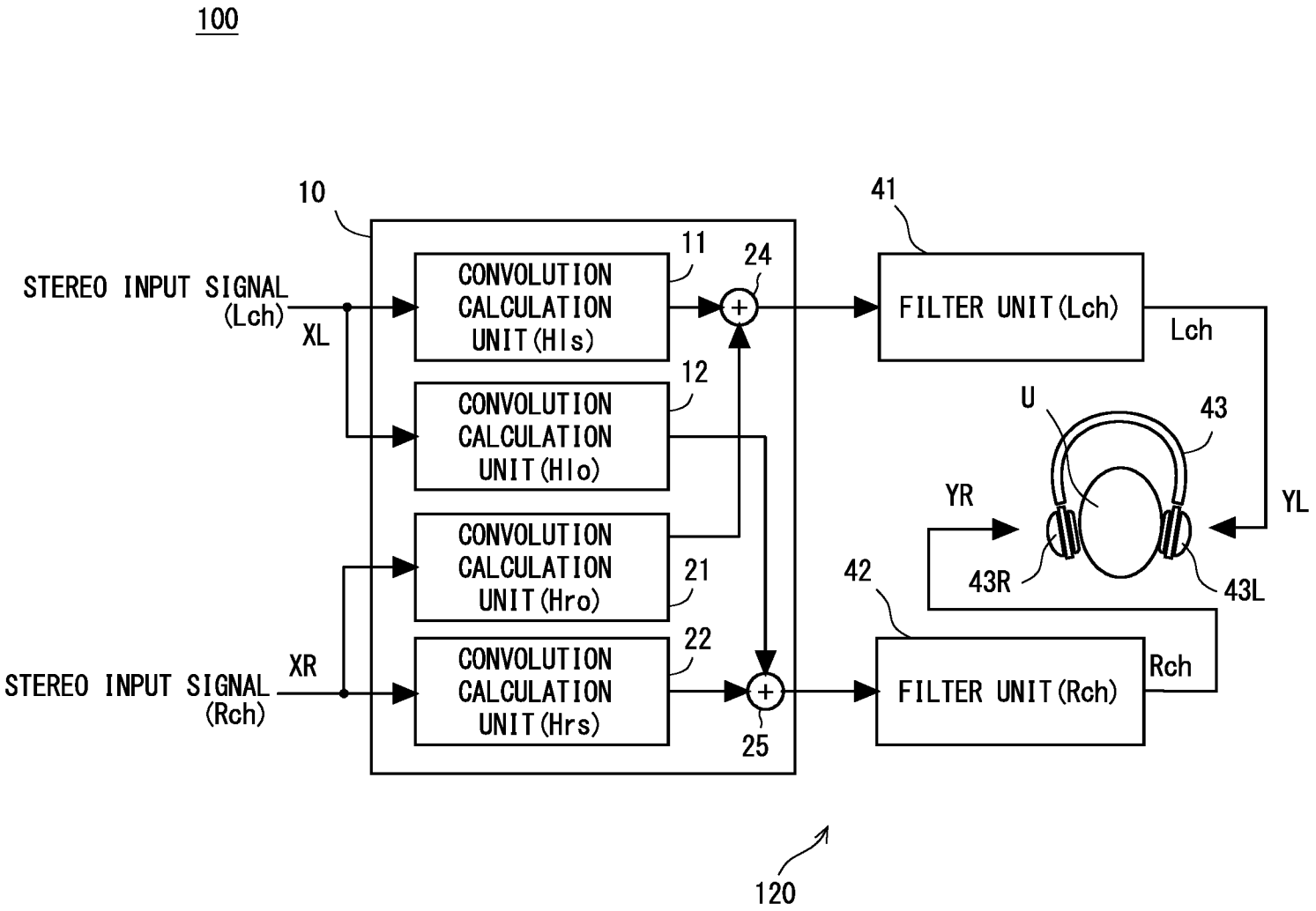
FIG. 1 is a block diagram showing an out-of-head localization device according to an embodiment.

The overview of sound localization processing is described hereinafter. Out-of-head localization, which is an example of a sound localization device, is described in the following example. The out-of-head localization processing according to this embodiment performs out-of-head localization by using spatial acoustic transfer characteristics and ear canal transfer characteristics. The spatial acoustic transfer characteristics are transfer characteristics from a sound source such as speakers to the ear canal. The ear canal transfer characteristics are transfer characteristics from the entrance of the ear canal to the eardrum. In this embodiment, out-of-head localization is implemented by measuring the ear canal transfer characteristics when headphones are worn and using this measurement data.

Out-of-head localization according to this embodiment is performed by a user terminal such as a personal computer (PC), a smartphone, or a tablet terminal. The user terminal is an information processor including processing means such as a processor, storage means such as a memory or a hard disk, display means such as a liquid crystal monitor, and input means such as a touch panel, a button, a keyboard and a mouse. The user terminal has a communication function to transmit and receive data. Further, output means (output unit) with headphones or earphones is connected to the user terminal.

To obtain high localization effect, it is preferable to generate an out-of-head localization filter by measuring characteristics of a user. However, it is possible that an appropriate measurement may not be performed for the user himself/herself. For example, in order to perform an appropriate measurement, it is required to place a microphone at an appropriate position on a user's ear. However, it is difficult for the user to appropriately adjust the position of the microphone by himself/herself.

To be specific, an out-of-head localization processing system includes a user terminal and a server device. The server device stores the spatial acoustic transfer characteristics and the ear canal transfer characteristics measured in advance on a plurality of persons being measured other than a user. Specifically, a measurement of the spatial acoustic transfer characteristics using speakers as a sound source (which is hereinafter also referred to as a first pre-measurement) and a measurement of the ear canal transfer characteristics using headphones as a sound source are performed by using a measurement device different from a user terminal.

Further, two types of microphones are used for the measurement of the ear canal transfer characteristics. The first type is a microphone embedded in the headphones (which is also referred to as a built-in microphone) and the second type is a microphone that is provided separately from the headphones (which is also referred to as an independent microphone). The measurement using the built-in microphone is referred to as a second pre-measurement and characteristics obtained in this measurement are referred to as first ear canal transfer characteristics. The measurement using the independent microphone is referred to as a third pre-measurement and characteristics obtained in this measurement are referred to as second ear canal transfer characteristics. The first to third pre-measurements are performed on a person being measured other than a user.

The server device stores first preset data regarding the first ear canal transfer characteristics and second preset data regarding the second ear canal transfer characteristics. As a result of performing the second and third pre-measurement on a plurality of persons being measured, a plurality of pieces of first preset data and a plurality of pieces of second preset data are acquired. The server device stores a plurality of pieces of first preset data and a plurality of pieces of second preset data in a database.

Further, for an individual user on which out-of-head localization is to be performed, only the first ear canal transfer characteristics are measured by using a user terminal (which is described hereinafter as a user measurement). The user measurement is measurement using a built-in microphone embedded in the headphones, just like in the case of the second pre-measurement. For an individual user, measurement using the independent microphone is not performed. The user terminal acquires measurement data regarding the first ear canal transfer characteristics. Then the user terminal transmits user data which is based on the measurement data to the server device.

The measurement by the built-in microphone can be performed in a simple manner since it does not require a microphone that is independent from headphones and there is no need to install a microphone or adjust the position of the microphone. On the other hand, in the measurement by a built-in microphone, it is difficult to place the microphone in an ideal position at the entrance of the ear canal. Therefore, the measurement using the built-in microphone alone may not be sufficient to generate an appropriate inverse filter. In an inverse filter that directly cancels out ear canal transfer characteristics measured using a built-in microphone, it is possible that a high out-of-head localization effect for a user may not be obtained.

In order to solve the above problem, the server device calculates a representative conversion function that converts first ear canal transfer characteristics (first preset data) into second ear canal transfer characteristics (second preset data). The server device calculates the second ear canal transfer characteristics by applying a representative conversion function to user data. The server device or the user terminal generates an inverse filter based on the second ear canal transfer characteristics. The server device includes a plurality of representative conversion functions and extracts a representative conversion function suitable for a user by matching. The server device transmits the representative conversion function to a user terminal. The user terminal generates an inverse filter by applying the representative conversion function to the user data. The out-of-head localization is performed using the inverse filter which is based on a user measurement.

In the following description, processing of generating an inverse filter that cancels out ear canal transfer characteristics from results of user measurement using a built-in microphone will be mainly described. While a configuration of first pre-measurement for measuring spatial acoustic transfer characteristics will be described in the following description, the first pre-measurement may be omitted as appropriate.

(Out-of-Head Localization Device)

First, an out-of-head localization device 100, which is an example of a sound field reproduction device according to this embodiment, is shown in FIG. 1. FIG. 1 is a block diagram of the out-of-head localization device 100. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a Compact Disc (CD) player or the like or digital audio data such as MPEG Audio Layer-3 (mp3). Note that the out-of-head localization device 100 is not limited to a physically single device, and a part of processing may be performed in a different device. For example, a part of processing may be performed by a PC or the like, and the rest of processing may be performed by a Digital Signal Processor (DSP) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 constitute an arithmetic processing unit 120, which is described later, and they can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves a filter of the spatial acoustic transfer characteristics (which is referred hereinafter also as a spatial acoustic filter) into each of the stereo input signals XL and XR having the respective channels. The spatial acoustic transfer characteristics may be a head-related transfer function HRTF measured in the head or auricle of a measured person, or may be the head-related transfer function of a dummy head or a third person.

The spatial acoustic transfer function is a set of four spatial acoustic transfer characteristics Hls, Hlo, Hro and Hrs. Data used for convolution in the convolution calculation units 11 to 12 and 21 to 22 is a spatial acoustic filter. Each of the spatial acoustic transfer characteristics Hls, Hlo, Hro and Hrs is measured using a measurement device, which is described later.

The convolution calculation unit 11 convolves the spatial acoustic filter in accordance with the spatial acoustic transfer characteristics Hls to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter is calculated from a result of measuring the characteristics of the user U.

The filter unit 41 outputs the processed L-ch signal to a left unit 43L of the headphones 43. The filter unit 42 outputs the processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2ch stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

(Measurement Device of Spatial Acoustic Transfer Characteristics)

Figure 2:
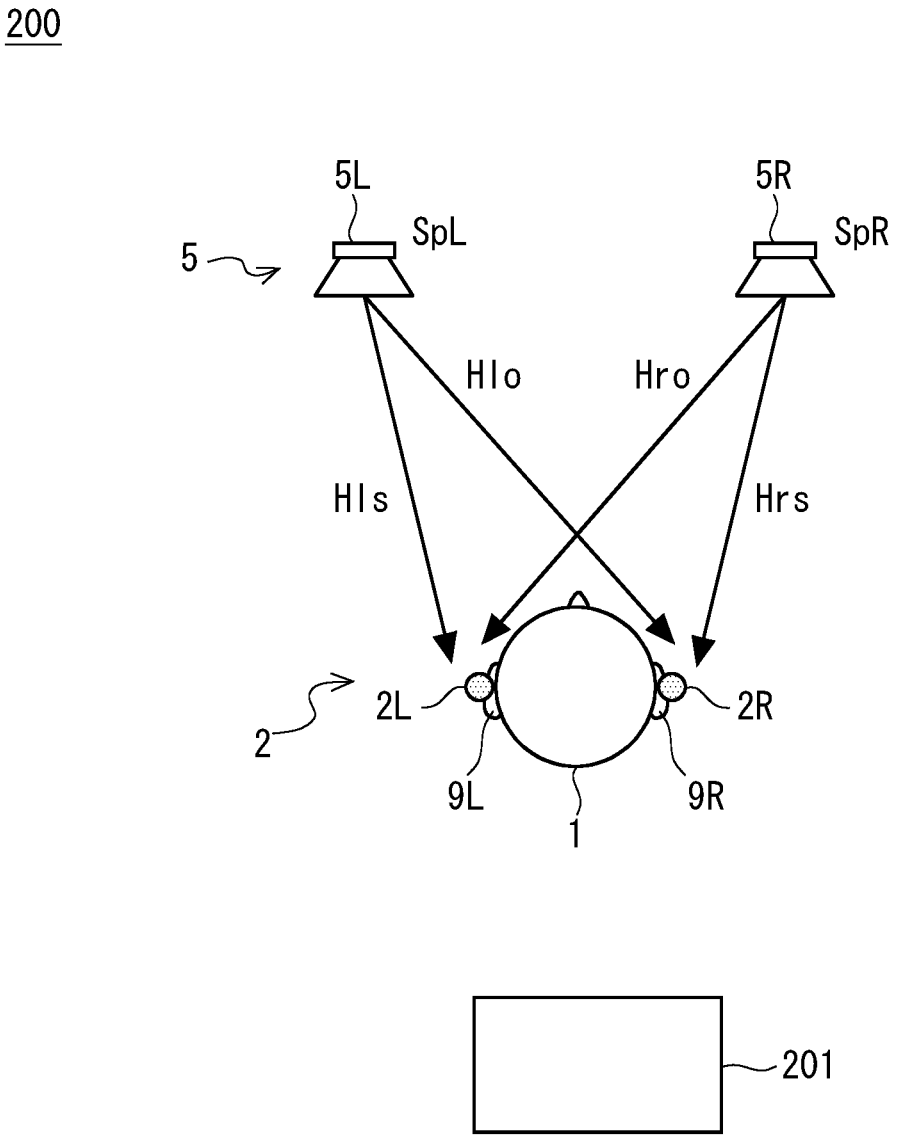
FIG. 2 is a view showing a structure of a measurement device for measuring spatial acoustic transfer characteristics.

A measurement device 200 for measuring the spatial acoustic transfer characteristics Hls, Hlo, Hro and Hrs is described hereinafter with reference to FIG. 2. FIG. 2 is a view schematically showing a measurement structure for performing the first pre-measurement on a person 1 being measured.

As shown in FIG. 2, the measurement device 200 includes a stereo speaker 5 and a microphone unit 2. The stereo speaker 5 is placed in a measurement environment. The measurement environment may be the user U's room at home, a dealer or showroom of an audio system or the like. The measurement environment is preferably a listening room where speakers and acoustics are in good condition.

In this embodiment, a measurement processor 201 of the measurement device 200 performs processing for appropriately generating the spatial acoustic filter. The measurement processor 201 includes a music player such as a CD player, for example. The measurement processor 201 may be a personal computer (PC), a tablet terminal, a smartphone or the like. Further, the measurement processor 201 may be a server device.

The stereo speaker 5 includes a left speaker 5L and a right speaker 5R. For example, the left speaker 5L and the right speaker 5R are placed in front of the person 1 being measured. The left speaker 5L and the right speaker 5R output impulse sounds for impulse response measurement and the like. Although the number of speakers, which serve as sound sources, is 2 (stereo speakers) in this embodiment, the number of sound sources to be used for measurement is not limited to 2, and it may be any number equal to or larger than 1. Therefore, this embodiment is applicable also to 1ch mono or 5.1ch, 7.1ch etc. multichannel environment.

The microphone unit 2 is stereo microphones including a left microphone 2L and a right microphone 2R. The left microphone 2L is placed on a left ear 9L of the person 1 being measured, and the right microphone 2R is placed on a right ear 9R of the person 1 being measured. To be specific, the microphones 2L and 2R are preferably placed at a position between the entrance of the ear canal and the eardrum of the left ear 9L and the right ear 9R, respectively. The microphones 2L and 2R pick up measurement signals output from the stereo speaker 5 and acquire sound pickup signals. The microphones 2L and 2R output the sound pickup signals to the measurement processor 201. The person 1 being measured may be a person or a dummy head. In other words, in this embodiment, the person 1 being measured is a concept that includes not only a person but also a dummy head.

As described above, impulse sounds output from the left and right speakers 5L and 5R are measured using the microphones 2L and 2R, respectively, and thereby impulse response is measured. The measurement processor 201 stores the sound pickup signals acquired by the impulse response measurement into a memory or the like. The spatial acoustic transfer characteristics Hls between the left speaker 5L and the left microphone 2L, the spatial acoustic transfer characteristics Hlo between the left speaker 5L and the right microphone 2R, the spatial acoustic transfer characteristics Hro between the right speaker 5R and the left microphone 2L, and the spatial acoustic transfer characteristics Hrs between the right speaker 5R and the right microphone 2R are thereby measured. Specifically, the left microphone 2L picks up the measurement signal that is output from the left speaker 5L, and thereby the spatial acoustic transfer characteristics Hls are acquired. The right microphone 2R picks up the measurement signal that is output from the left speaker 5L, and thereby the spatial acoustic transfer characteristics Hlo are acquired. The left microphone 2L picks up the measurement signal that is output from the right speaker 5R, and thereby the spatial acoustic transfer characteristics Hro are acquired. The right microphone 2R picks up the measurement signal that is output from the right speaker 5R, and thereby the spatial acoustic transfer characteristics Hrs are acquired.

Further, the measurement device 200 may generate the spatial acoustic filters in accordance with the spatial acoustic transfer characteristics Hls, Hlo, Hro, and Hrs from the left and right speakers 5L and 5R to the left and right microphones 2L and 2R based on the sound pickup signals. For example, the measurement processor 201 cuts out the spatial acoustic transfer characteristics Hls, Hlo, Hro, and Hrs with a specified filter length. The measurement processor 201 may correct the measured spatial acoustic transfer characteristics Hls, Hlo, Hro, and Hrs.

In this manner, the measurement processor 201 generates the spatial acoustic filter to be used for convolution calculation of the out-of-head localization device 100. As shown in FIG. 1, the out-of-head localization device 100 performs out-of-head localization processing by using the spatial acoustic filters in accordance with the spatial acoustic transfer characteristics Hls, Hlo, Hro, and Hrs between the left and right speakers 5L and 5R and the left and right microphones 2L and 2R. Specifically, the out-of-head localization processing is performed by convolving the spatial acoustic filters to the audio reproduced signals.

The measurement processor 201 performs the same processing on the sound pickup signals that correspond to the respective spatial acoustic transfer characteristics Hls, Hlo, Hro, and Hrs. Specifically, the same processing is performed on each of the four sound pickup signals that correspond to the spatial acoustic transfer characteristics Hls, Hlo, Hro, and Hrs. The spatial acoustic filters that respectively correspond to the spatial acoustic transfer characteristics Hls, Hlo, Hro, and Hrs are thereby generated.

(Measurement of First Ear Canal Transfer Characteristics)

Figure 3:
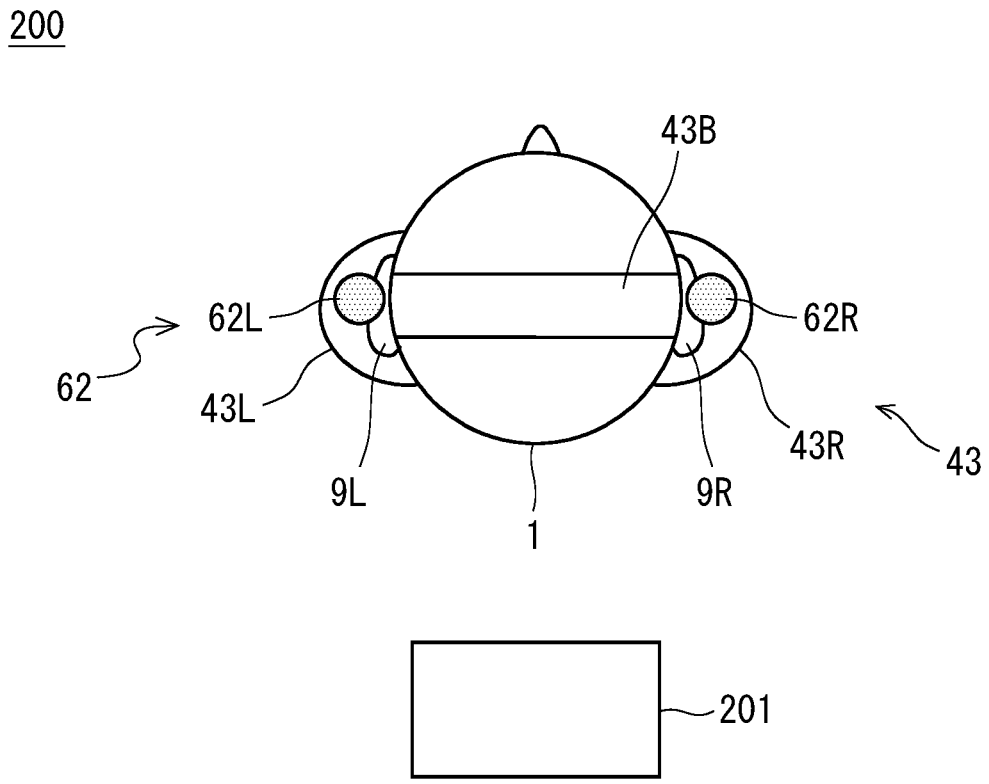
FIG. 3 is a view showing a structure of a measurement device for measuring first ear canal transfer characteristics.

Referring next to FIG. 3, a measurement device 200 for measuring the first ear canal transfer characteristics will be described. FIG. 3 shows a structure for performing the second pre-measurement on the person 1 being measured.

A microphone unit 62 and headphones 43 are connected to a measurement processor 201. The microphone unit 62 includes a left microphone 62L and a right microphone 62R. The left microphone 62L is worn on a left ear 9L of a person 1 being measured and the right microphone 62R is worn on a right ear 9R of the person 1 being measured. The measurement processor 201 and the microphones 62L and 62R may be the same as or different from the measurement processor 201 and the microphones 2L and 2R in FIG. 2. The microphone unit 62 is a built-in microphone unit embedded in the headphones 43.

The headphones 43 includes a headphone band 43B, a left unit 43L, and a right unit 43R. The headphone band 43B connects the left unit 43L and the right unit 43R. The left unit 43L outputs a sound toward the left ear 9L of the person 1 being measured. The right unit 43R outputs a sound toward the right ear 9R of the person 1 being measured. The type of the headphones 43 may be closed, open, semi-open, semi-closed or any other type. The headphones 43 are worn on the person 1 being measured while the microphone 62 is worn on this person. Specifically, the left unit 43L and the right unit 43R of the headphones 43 are worn on the left ear 9L and the right ear 9R on which the left microphone 62L and the right microphone 62R are worn, respectively. The headphone band 43B generates an urging force to press the left unit 43L and the right unit 43R against the left ear 9L and the right ear 9R, respectively.

The left microphone 62L picks up the sound output from the left unit 43L of the headphones 43. The right microphone 62R picks up the sound output from the right unit 43R of the headphones 43. A microphone part of each of the left microphone 62L and the right microphone 62R is placed at a sound pickup position near the external acoustic opening. The left microphone 62L and the right microphone 62R are formed not to interfere with the headphones 43. The left microphone 62L and the right microphone 62R are respectively included in the left unit 43L and the right unit 43R of the headphones 43. For example, the left microphone 62L is fixed in the housing of the left unit 43L and the right microphone 62R is fixed in the housing of the right unit 43R.

The measurement processor 201 outputs measurement signals to the left unit 43L and the right unit 43R. The left unit 43L and the right unit 43R thereby generate impulse sounds or the like. To be specific, an impulse sound output from the left unit 43L is measured by the left microphone 62L. An impulse sound output from the right unit 43R is measured by the right microphone 62R. Impulse response measurement is performed in this manner.

The measurement processor 201 stores the sound pickup signals acquired based on the impulse response measurement into a memory or the like. The transfer characteristics between the left unit 43L and the left microphone 62L (which is the first ear canal transfer characteristics of the left ear) and the transfer characteristics between the right unit 43R and the right microphone 62R (which is the first ear canal transfer characteristics of the right ear) are thereby acquired. Measurement data of the first ear canal transfer characteristics of the left ear acquired by the left microphone 62L is referred to as measurement data ECTFL_1, and measurement data of the first ear canal transfer characteristics of the right ear acquired by the right microphone 62R is referred to as measurement data ECTFR_1.

The measurement processor 201 includes a memory or the like that stores the measurement data ECTFL_1 and ECTFR_1. Note that the measurement processor 201 generates an impulse signal, a Time Stretched Pulse (TSP) signal or the like as the measurement signal for measuring the ear canal transfer characteristics and the spatial acoustic transfer characteristics. The measurement signal contains a measurement sound such as an impulse sound. The headphones 43 and the microphone unit 62 for a plurality of persons 1 being measured are preferably unified.

(Measurement of Second Ear Canal Transfer Characteristics)

Figure 4:
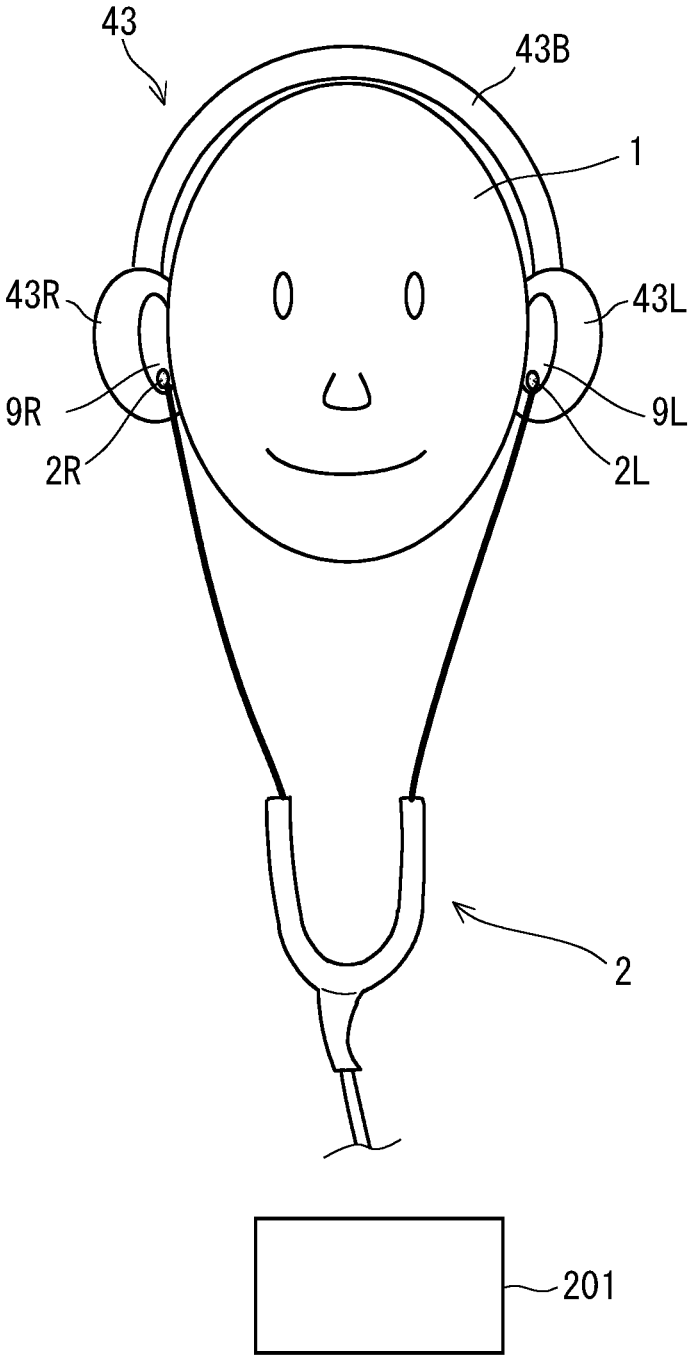
FIG. 4 is a view showing a structure of a measurement device for measuring second ear canal transfer characteristics.

With reference to FIG. 4, a measurement device 200 for measuring second ear canal transfer characteristics will be described. FIG. 4 schematically shows a structure for performing third pre-measurement on a person 1 being measured.

In FIG. 4, a microphone unit 2 is an independent microphone unit that is independent from headphones 43. The microphone unit 2 has a stethoscope-like structure, as disclosed in Japanese Unexamined Patent Application Publication No. 2018-133708. Since the structure of the microphone unit 2 is described in detail in Japanese Unexamined Patent Application Publication No. 2018-133708, the description thereof will be omitted. As a matter of course, a microphone unit 2 having a structure other than a stethoscope-like structure may instead be used. The microphone unit 2 may be the same as that used in the first pre-measurement.

A left microphone 2L is worn on a left ear 9L and a right microphone 2R is worn on a right ear 9R. Then the person 1 being measured wears the headphones 43 so as to cover the left and right microphones 2L and 2R. That is, the person 1 being measured wears the headphones 43 so as to cover the ears 9L and 9R on which the microphones 2L and 2R are worn. The headphones 43 used in the second pre-measurement and those used in the third pre-measurement are of the same type. The headphones 43 and the microphone unit 2 for a plurality of persons 1 being measured are preferably unified.

The left microphone 2L picks up the sound output from the left unit 43L of the headphones 43. The right microphone 2R picks up the sound output from the right unit 43R of the headphones 43. A microphone part of each of the left microphone 2L and the right microphone 2R is placed at a sound pickup position near the external acoustic opening. The left microphone 2L and the right microphone 2R are formed not to interfere with the headphones 43. Specifically, the person 1 being measured can wear the headphones 43 in the state where the left microphone 2L and the right microphone 2R are placed at appropriate positions of the left ear 9L and the right ear 9R, respectively. Further, the microphones 2L and 2R are placed at sound pickup positions different from those in the microphones 2L and 2R shown in FIG. 3.

The measurement processor 201 outputs measurement signals to the left unit 43L and the right unit 43R. The left unit 43L and the right unit 43R thereby generate impulse sounds or the like. To be specific, an impulse sound output from the left unit 43L is measured by the left microphone 2L. An impulse sound output from the right unit 43R is measured by the right microphone 2R. Impulse response measurement is performed in this manner.

The measurement processor 201 stores the sound pickup signals based on the impulse response measurement into a memory or the like. The transfer characteristics between the left unit 43L and the left microphone 2L (which is the second ear canal transfer characteristics of the left ear) and the transfer characteristics between the right unit 43R and the right microphone 2R (which is the second ear canal transfer characteristics of the right ear) are thereby acquired. Measurement data of the second ear canal transfer characteristics of the left ear acquired by the left microphone 2L is referred to as measurement data ECTFL_2 and measurement data of the second ear canal transfer characteristics of the right ear acquired by the right microphone 2R is referred to as measurement data ECTFR_2.

The measurement processor 201 includes a memory or the like that stores the measurement data ECTFL_2 and ECTFR_2. Note that the measurement processor 201 generates an impulse signal, a Time Stretched Pulse (TSP) signal or the like as the measurement signal for measuring the ear canal transfer characteristics and the spatial acoustic transfer characteristics. The measurement signal contains a measurement sound such as an impulse sound.

By the measurement device 200 shown in FIGS. 3 and 4, the first and second ear canal transfer characteristics of a plurality of persons 1 being measured are measured. In this embodiment, the second pre-measurement by the measurement structure in FIG. 3 is performed on the plurality of persons 1 being measured. Likewise, the third pre-measurement by the measurement structure in FIG. 4 is performed on the plurality of persons 1 being measured. The first and second ear canal transfer characteristics are thereby measured for each person 1 being measured.

(Out-of-Head Localization Filter Generation System)

Figure 5:
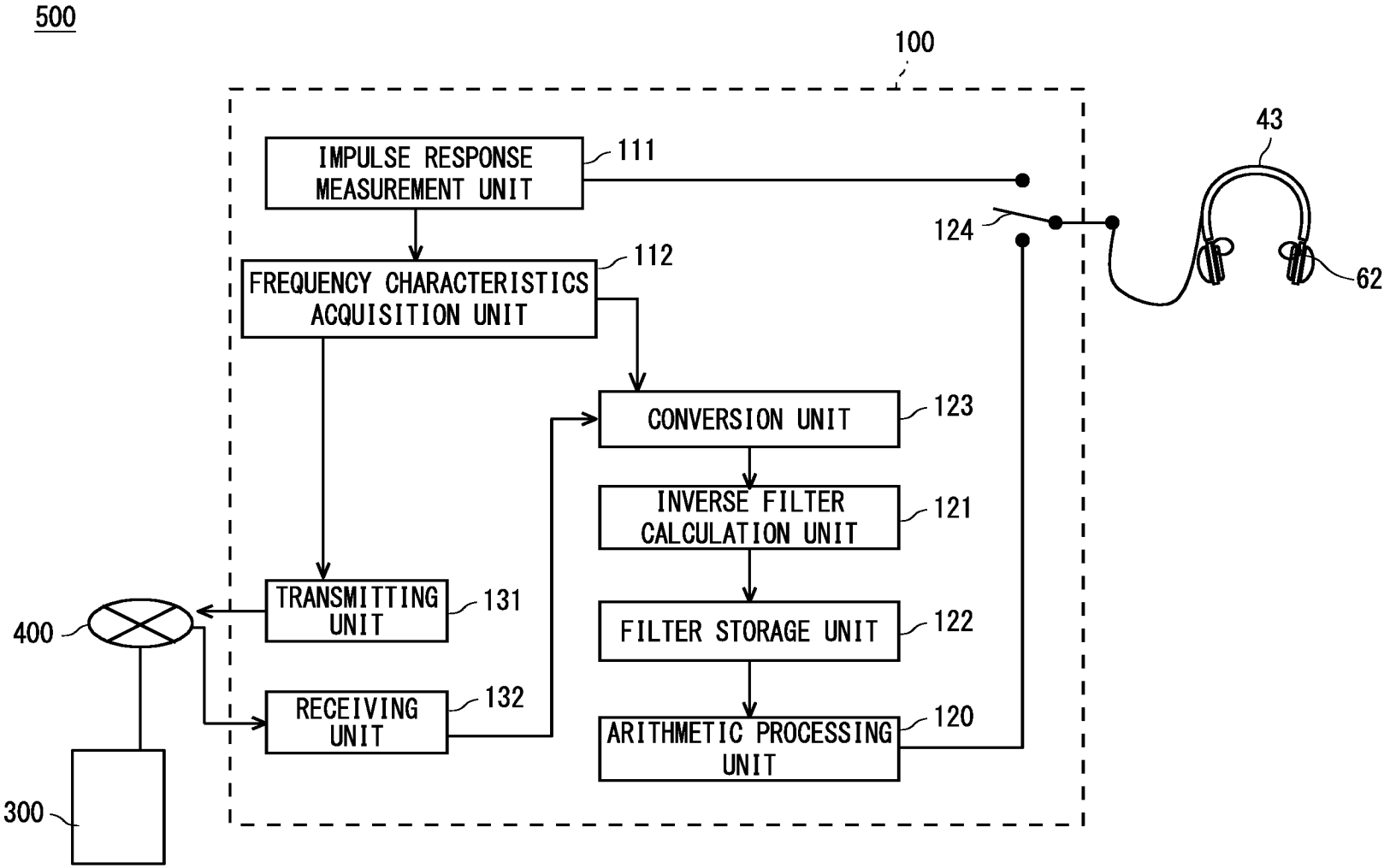
FIG. 5 is a view showing the overall structure of an out-of-head localization filter generation system according to this embodiment.

An out-of-head localization filter determination system 500 according to this embodiment is described hereinafter with reference to FIG. 5. FIG. 5 is a view showing the overall structure of the out-of-head localization filter determination system 500. The out-of-head localization filter determination system 500 includes a microphone unit 62, headphones 43, an out-of-head localization device 100, and a server device 300.

The out-of-head localization device 100 and the server device 300 are connected to each other through a network 400. The network 400 is a public network such as the Internet or a mobile phone communication network, for example. The out-of-head localization device 100 and the server device 300 can communicate with each other by wireless or wired. Note that the out-of-head localization device 100 and the server device 300 may be an integral device.

The out-of-head localization device 100 is a user terminal that outputs a reproduced signal on which out-of-head localization has been performed to the user U, as shown in FIG. 1. Further, the out-of-head localization device 100 performs measurement of the ear canal transfer characteristics of the user U. The microphone unit 62 and the headphones 43 are connected to the out-of-head localization device 100. The out-of-head localization device 100 performs impulse response measurement using the microphone unit 62 and the headphones 43, just like the measurement device 200 in FIG. 3. Note that the out-of-head localization device 100 may be connected to the microphone unit 62 and the headphones 43 wirelessly by Bluetooth (registered trademark) or the like. The microphone unit 62 is a built-in microphone unit embedded in the headphones 43, like in FIG. 3.

The out-of-head localization device 100 includes an impulse response measurement unit 111, a frequency characteristics acquisition unit 112, a transmitting unit 131, a receiving unit 132, an arithmetic processing unit 120, an inverse filter calculation unit 121, a filter storage unit 122, a conversion unit 123, and a switch 124. Note that, when the out-of-head localization device 100 and the server device 300 are an integral device, this device may include an acquisition unit that acquires user data in place of the receiving unit 132.

The switch 124 switches user measurement and out-of-head localization reproduction. Specifically, for user measurement, the switch 124 connects the headphones 43 to the impulse response measurement unit 111. For out-of-head localization reproduction, the switch 124 connects the headphones 43 to the arithmetic processing unit 120.

First, processing for obtaining the inverse filter of the ear canal transfer characteristics will be described. The impulse response measurement unit 111 outputs measurement signals, which are impulse sounds, to the headphones 43 in order to perform user measurement. The microphone unit 62 picks up the impulse sounds output from the headphones 43. In this example, the microphone unit 62 is included in the headphones 43. Further, the microphone unit 62 may be detachably attached to the headphones 43.

The headphones 43 outputs sound pickup signals to the impulse response measurement unit 111. Since the impulse response measurement is similar to that in the description with reference to FIG. 3, the description thereof is omitted as appropriate. That is, the out-of-head localization device 100 has similar functions as those of the measurement processor 201 in FIG. 3. The out-of-head localization device 100, the microphone unit 62, and the headphones 43 form a measurement device that performs user measurement. The impulse response measurement unit 111 may perform A/D conversion, synchronous addition and the like of the sound pickup signals.

By the impulse response measurement, the impulse response measurement unit 111 acquires the measurement data ECTF_1 related to the first ear canal transfer characteristics. The measurement data ECTF_1 contains the measurement data ECTFL_1 related to the first ear canal transfer characteristics of the left ear 9L of the user U and the measurement data ECTFR_1 related to the first ear canal transfer characteristics of the right ear 9R.

The frequency characteristics acquisition unit 112 performs specified processing on the measurement data ECTFL_1 and ECTFR_1 and thereby acquires the frequency characteristics of the measurement data ECTFL_1 and ECTFR_1. For example, the frequency characteristics acquisition unit 112 calculates frequency-amplitude characteristics and frequency-phase characteristics by performing discrete Fourier transform. Further, the frequency characteristics acquisition unit 112 may calculate frequency-amplitude characteristics and frequency-phase characteristics by means for converting a discrete signal into a frequency domain such as discrete cosine transform, instead of performing discrete Fourier transform. Instead of the frequency-amplitude characteristics, frequency-power characteristics may be used.

The frequency characteristics obtained by the user measurement are referred to as first frequency characteristics user-bim (or first ear canal transfer characteristics user-bim). The first frequency characteristics user-bim include frequency-amplitude characteristics of the first ear canal transfer characteristics. Further, the first frequency characteristics user-bim related to the left ear are referred to as first frequency characteristics userL-bim (or first ear canal transfer characteristics userL-bim). The first frequency characteristics user-bim related to the right ear are referred to as first frequency characteristics userR-bim (or first ear canal transfer characteristics userR-bim). The first frequency characteristics user-bim include first frequency characteristics userL-bim and first frequency characteristics userR-bim.

The transmitting unit 131 transmits, as user data (user feature quantities), the first frequency characteristics user-bim to the server device 300. The transmitting unit 131 performs processing (for example, modulation) in accordance with a communication standard on the user data and transmits the obtained data. The transmitting unit 131 may transmit, as the user data, an amplitude value of the first frequency characteristics user-bim.

The server device 300 determines a representative conversion function based on the first frequency characteristics user-bim. The representative conversion function is a function for converting the frequency characteristics of the first ear canal transfer characteristics into frequency characteristics of the second ear canal transfer characteristics. The frequency characteristics of the second ear canal transfer characteristics of the user are referred to as second frequency characteristics user-Stetho (or second ear canal transfer characteristics user-Stetho). Processing for determining the representative conversion function will be described later.

The server device 300 transmits the representative conversion function to the out-of-head localization device 100. The receiving unit 132 receives the representative conversion function from the server device 300. The conversion unit 123 calculates the second frequency characteristics user-Stetho by applying the representative conversion function to the first frequency characteristics user-bim. Specifically, the conversion unit 123 converts the first frequency characteristics user-bim into the second frequency characteristics user-Stetho using the representative conversion function.

Figure 6:
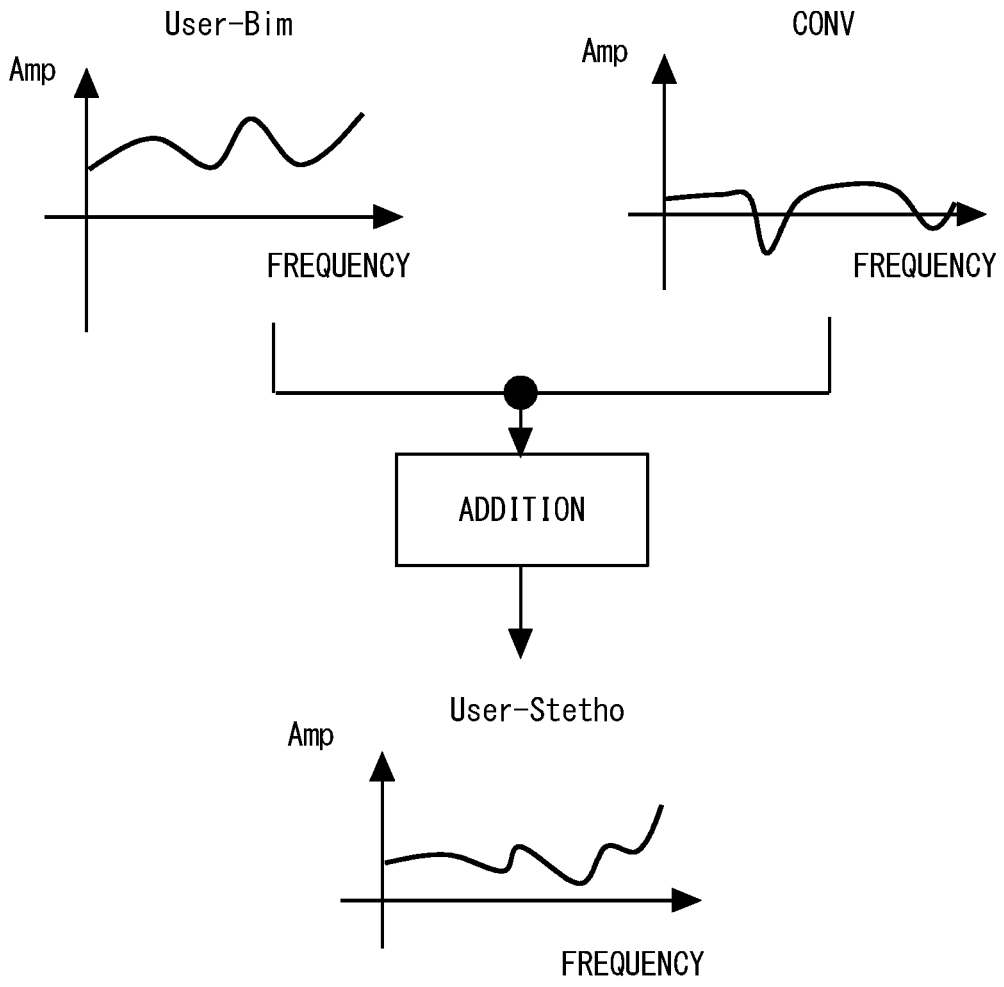
FIG. 6 is a view for describing processing of applying a representative conversion function to first frequency characteristics.

With reference to FIG. 6, processing for converting the first frequency characteristics user-bim into the second frequency characteristics user-Stetho using the representative conversion function will be described. FIG. 6 shows, as the representative conversion function, a representative difference value vector CONV of the frequency-amplitude characteristics. In one example shown in FIG. 6, the second frequency characteristics user-Stetho are calculated by adding the representative difference value vector CONV to the first frequency characteristics user-bim on a frequency domain. Note that the representative conversion function is not limited to addition of the representative difference value vector of the frequency-amplitude characteristics and may be a representative transfer function itself calculated using the spatial transfer function between the first frequency characteristics user-bim and the second frequency characteristics user-Stetho. In the graph shown in FIG. 6, the horizontal axis indicates a frequency and the vertical axis indicates an amplitude value (amplitude level).

An amplitude value is set for each of the first frequency characteristics user-bim and the representative difference value vector CONV for each frequency. The first frequency characteristics user-bim and the representative difference value vector CONV are indicated as multidimensional vectors including a plurality of amplitude values. While the first frequency characteristics user-bim and the representative difference value vector CONV are in vector form with the same number of dimensions, they may be in vector form with different number of dimensions. When they are in vector form with different number of dimensions, the representative difference value vector CONV may be added by performing interpolation as appropriate. The second frequency characteristics user-Stetho and the first frequency characteristics user-bim are in vector form with the same number of dimensions.

More specifically, by applying the representative difference value vector CONV_L to the first frequency characteristics userL-bim of the left ear as a function, the second frequency characteristics userL-Stetho of the left ear are calculated. Likewise, by applying the representative difference value vector CONV_R to the first frequency characteristics userR-bim of the right ear as a function, the second frequency characteristics userR-Stetho of the right ear are calculated. The representative difference value vector CONV_L of the left ear and the representative difference value vector CONV_R of the right ear may be the same vector or different vectors.

The inverse filter calculation unit 121 calculates an inverse filter based on the second frequency characteristics user-Stetho. For example, the inverse filter calculation unit 121 corrects the second frequency characteristics user-Stetho. The inverse filter calculation unit 121 obtains the inverse characteristics so as to cancel out amplitude spectra of the second frequency characteristics user-Stetho. The inverse characteristics are amplitude spectra having filter coefficients that cancel out amplitude spectra.

The inverse filter calculation unit 121 calculates signals of the time domain from the inverse characteristics and the phase characteristics by inverse discrete Fourier transform or inverse discrete cosine transform. The inverse filter calculation unit 121 generates a temporal signal by performing inverse fast Fourier transform (IFFT) on the inverse characteristics and the phase characteristics. The inverse filter calculation unit 121 calculates an inverse filter by cutting out the generated temporal signal with a specified filter length. The inverse filter calculation unit 121 generates inverse filters Linv and Rinv by performing similar processing on the sound pickup signals from the microphones 62L and 62R. The inverse filter Linv is generated based on the second frequency characteristics userL-stetho and the inverse filter Rinv is generated based on the second frequency characteristics userR-stetho. Since a known method can be used as the processing for obtaining the inverse filters, the detailed description thereof will be omitted.

As described above, the inverse filter is a filter that cancels out headphone characteristics (characteristics between a reproduction unit of headphones and a microphone). The filter storage unit 122 stores left and right inverse filters calculated by the inverse filter calculation unit 121. Accordingly, the inverse filters Linv and Rinv are set in the filter units 41 and 42 shown in FIG. 1.

Figure 7:
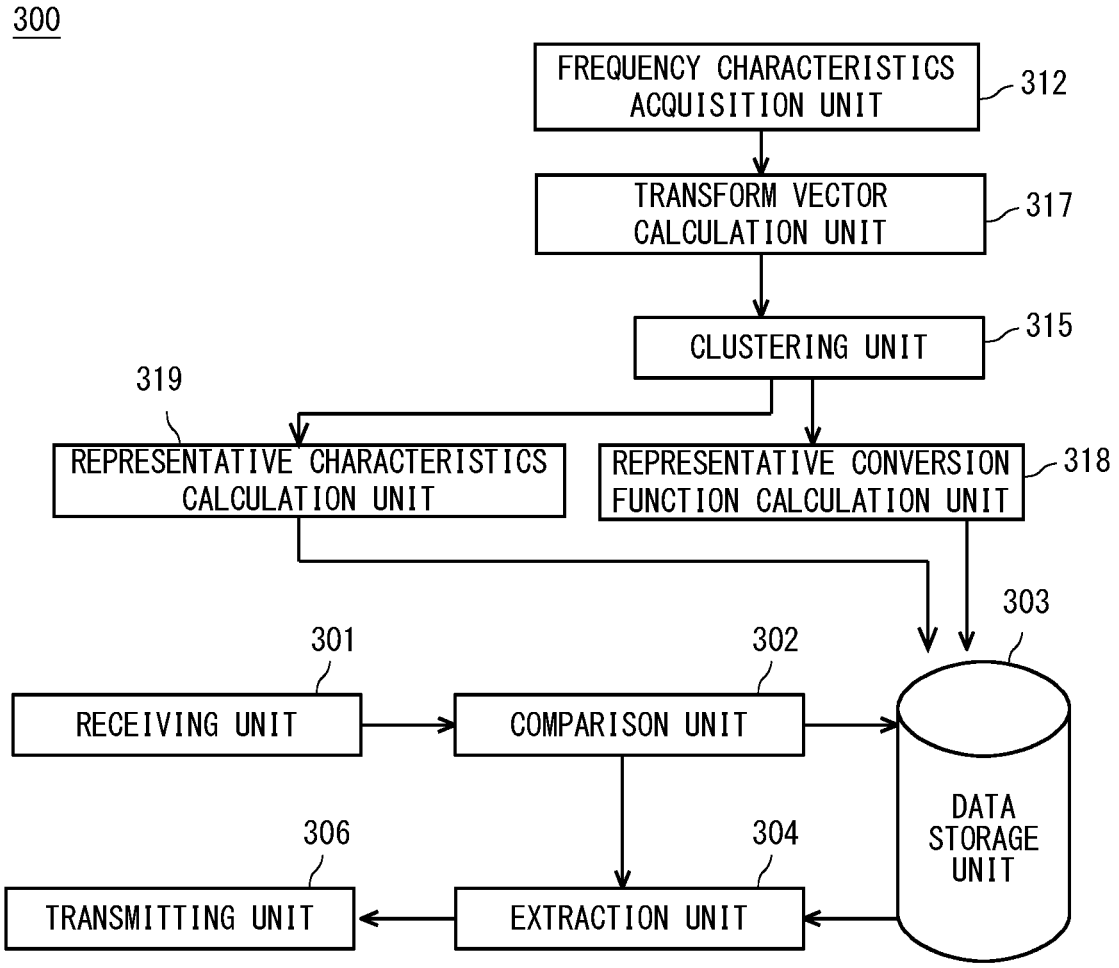
FIG. 7 is a block diagram showing a structure of a server device.

With reference to FIG. 7, processing for obtaining the representative conversion function will be described. FIG. 7 is a block diagram showing a structure of the server device 300. The server device 300 includes a receiving unit 301, a comparison unit 302, a data storage unit 303, an extraction unit 304, and a transmitting unit 306. The server device 300 is a processor for obtaining the representative conversion function based on the user data. When the out-of-head localization device 100 and the server device 300 are an integral device, this device may not include the transmitting unit 306 and the like.

The server device 300 further includes a frequency characteristics acquisition unit 312, a clustering unit 315, a transform vector calculation unit 317, a representative conversion function calculation unit 318, and a representative characteristics calculation unit 319.

The server device 300 is a computer including a processor, a memory and the like, and performs the following processing according to a program. Further, the server device 300 is not limited to a single device, and it may be implemented by combining two or more devices, or may be a virtual server such as a cloud server. The data storage unit 303 that stores data, and the comparison unit 302, the extraction unit 304 and the like that perform data processing may be physically separate devices.

The data storage unit 303 is a database that stores, as preset data, data related to a plurality of persons being measured obtained by pre-measurement. The data stored in the data storage unit 303 is described hereinafter with reference to FIG. 8. FIG. 8 is a table showing the data stored in the data storage unit 303.

The data storage unit 303 stores preset data for each of the left and right ears of a person being measured. To be specific, the data storage unit 303 is in table format where ID of person being measured, left/right of ear, the first ear canal transfer characteristics, and the second ear canal transfer characteristics are arranged in one row. Note that the data format shown in FIG. 8 is an example, and a data format where objects of each parameter are stored in association by tag or the like may be used instead of the table format.

Two data sets are stored for one person A being measured in the data storage unit 303. Specifically, a data set related to the left ear of the person A being measured and a data set related to the right ear of the person A being measured are stored in the data storage unit 303.

One data set contains ID of person being measured, left/right of ear, the first ear canal transfer characteristics, and the second ear canal transfer characteristics. The first ear canal transfer characteristics, which are data based on the second pre-measurement by the measurement device 200 shown in FIG. 3, are first preset data. The first ear canal transfer characteristics are frequency-amplitude characteristics of the first ear canal transfer characteristics acquired by the microphones 62L and 62R embedded in the headphones 43. The second ear canal transfer characteristics, which are data based on the third pre-measurement by the measurement device 200 shown in FIG. 4, are second preset data. The second ear canal transfer characteristics are frequency-amplitude characteristics of the second ear canal transfer characteristics acquired by the microphones 2L and 2R provided independently from the headphones 43.

The first ear canal transfer characteristics of the left ear of the person A being measured are denoted by first ear canal transfer characteristics AL_bim and the first ear canal transfer characteristics of the right ear of the person A being measured are denoted by first ear canal transfer characteristics AR_bim. The first ear canal transfer characteristics of the left ear of the person B being measured are denoted by first ear canal transfer characteristics BL_bim and the first ear canal transfer characteristics of the right ear of the person B being measured are denoted by first ear canal transfer characteristics BR_bim. While the headphones 43 and the microphone unit 62 used for the user measurement and those used for the second pre-measurement are preferably of the same type, they may be of different types. The first ear canal transfer characteristics AL_bim, AR_bim, BL_bim, and BR_bim are first preset data.

The second ear canal transfer characteristics of the left ear of the person A being measured are denoted by second ear canal transfer characteristics AL_Stetho and the second ear canal transfer characteristics of the right ear of the person A being measured are denoted by second ear canal transfer characteristics AR_Stetho. The second ear canal transfer characteristics of the left ear of the person B being measured are denoted by second ear canal transfer characteristics BL_Stetho and the second ear canal transfer characteristics of the right ear of the person B being measured are denoted by second ear canal transfer characteristics BR_Stetho. The second ear canal transfer characteristics AL_Stetho, AR_Stetho, BL_Stetho, and BR_Stetho are second preset data.

The frequency characteristics acquisition unit 312 acquires frequency characteristics of the first and the second ear canal transfer characteristics. In this example, the frequency characteristics acquisition unit 312 calculates the frequency-amplitude characteristics of the first and second ear canal transfer characteristics as frequency characteristics. Since the processing of the frequency characteristics acquisition unit 312 is similar to the processing of the frequency characteristics acquisition unit 112, the description thereof is omitted as appropriate.

The transform vector calculation unit 317 is a conversion function calculation unit that calculates a difference value vector of the frequency-amplitude characteristics related to the first ear canal transfer characteristics and the second ear canal transfer characteristics of the person being measured as a conversion function. For example, a difference value vector of the frequency-amplitude characteristics related to the first ear canal transfer characteristics AL_bim and the second ear canal transfer characteristics AL_Stetho of the left ear of the person A being measured is referred to as a difference value vector AL_CONV. The difference value vector AL_CONV can be obtained, for example, from the following Expression (1).

$$AL_CONV = AL_Stetho - AL_bim \quad (1)$$

The difference value vector AL_CONV can be obtained by subtracting the amplitude value of the first ear canal transfer characteristics AL_bim from the amplitude value of the second ear canal transfer characteristics AL_Stetho for each frequency. That is, the difference value vector AL_CONV is a set of difference values between the second ear canal transfer characteristics AL_Stetho and the first ear canal transfer characteristics AL_bim. In other words, by adding the difference value vector AL_CONV to the first ear canal transfer characteristics AL_bim, the second ear canal transfer characteristics AL_Stetho can be obtained.

Likewise, the transform vector calculation unit 317 calculates the difference value vector for each data set. The difference value vector AR_CONV, which is a difference value vector related to the right ear of the person A being measured, is calculated based on the first ear canal transfer characteristics AR_bim and the second ear canal transfer characteristics AR_Stetho. The difference value vector BL_CONV, which is a difference value vector related to the left ear of the person B being measured, is calculated based on the first ear canal transfer characteristics BL_bim and the second ear canal transfer characteristics BL_Stetho. The difference value vector BR_CONV, which is a difference value vector related to the right ear of the person B being measured, is calculated based on the first ear canal transfer characteristics BR_bim and the second ear canal transfer characteristics BR_Stetho. While the transform vector calculation unit 317 calculates the difference value vector between the first ear canal transfer characteristics and the second ear canal transfer characteristics as a transform vector (conversion function), the transform vector calculation unit 317 may calculate a vector or a function other than the difference value vector as the conversion function.

The clustering unit 315 clusters a plurality of persons being measured based on the difference value vector of the plurality of persons being measured. In this example, the clustering unit 315 divides a data set into a plurality of clusters (groups) based on the difference value vector. The clustering unit 315 is able to perform clustering in accordance with the distance between feature quantity vectors by using the difference value vector as a feature quantity vector. The clustering may either be non-hierarchical clustering or hierarchical clustering. Further, while clustering is performed using the difference value vector of the frequency-amplitude characteristics as a feature quantity in this example, it is merely one example. For example, the feature quantity for clustering may be a spatial transfer function itself between the first ear canal transfer characteristics and the second ear canal transfer characteristics.

For example, the clustering unit 315 classifies the plurality of data sets into k clusters by a k-means method in which data is classified into a predetermined k (k is an integer equal to or larger than 2) clusters. One cluster includes a plurality of data sets. One cluster includes first preset data acquired by second pre-measurement on a plurality of persons being measured. First preset data regarding a plurality of ears belong to one cluster. One cluster includes a plurality of data sets shown in FIG. 8. Note that the clustering method is not limited to the k-means method.

The representative conversion function calculation unit 318 calculates a representative conversion function for each cluster. The representative conversion function calculation unit 318 calculates a representative conversion function based on the difference value vector of a plurality of data sets included in one cluster. The representative conversion function is a feature quantity vector that represents features of a plurality of difference value vectors that belong to a cluster.

FIG. 9 is a table for describing data of each cluster. FIG. 9 is a table showing data of k clusters. One or more persons being measured belong to each cluster.

The representative difference value vector 1_CONV is a feature quantity vector obtained by collecting median values of difference value vectors of persons being measured who belong to the first cluster (cluster 1) for each frequency. Likewise, the representative difference value vector 2_CONV is a feature quantity vector obtained by collecting median values of difference value vectors of persons being measured who belong to the second cluster (cluster 2) for each frequency. The representative difference value vector k_CONV is a feature quantity vector obtained by collecting median values of difference value vectors of persons being measured who belong to the k-th cluster (cluster k) for each frequency.

For example, a median value of a plurality of difference value vectors that belong to a cluster may be a representative conversion function. The representative conversion function calculation unit 318 obtains a median value of the difference values for each frequency and uses this median value as the representative difference value. The representative conversion function calculation unit 318 synthesizes representative difference values for all the bands and generates a representative difference value vector in all the bands. This representative difference value vector is applied as a function. The applied function is referred to as a representative conversion function. As a matter of course, an average value of the difference value vectors, not the median value of them, may be set as the representative value. Further, the representative conversion function may be a value (curve) by polynomial approximation. The representative conversion function and the difference value vector of each person being measured are in vector form with the same number of dimensions.

The representative characteristics calculation unit 319 calculates representative characteristics for each cluster. The representative characteristics calculation unit 319 calculates representative characteristics based on the first ear canal transfer characteristics of the plurality of data sets included in one cluster. The representative characteristics are feature quantity vectors that represent the features of a plurality of first ear canal transfer characteristics that belong to a cluster.

The first cluster includes representative characteristics 1_bim. Likewise, the second cluster includes representative characteristics 2_bim. The k-th cluster includes representative characteristics k_bim. In this manner, representative characteristics that represent a cluster are obtained for each cluster. The representative characteristics are data that correspond to the first ear canal transfer characteristics.

For example, an average value of a plurality of first ear canal transfer characteristics that belong to a cluster may be set as representative characteristics. The representative characteristics calculation unit 319 obtains an average value of amplitude values for each frequency and uses this average value as a representative value. A set of representative values for all the bands are representative characteristics. As a matter of course, a median value of the first ear canal transfer characteristics, not the average value thereof, may be used as the representative value. The representative characteristics may be values (curves) by polynomial approximation. The representative characteristics and the first ear canal transfer characteristics of each person being measured are in vector form with the same number of dimensions.

As described above, each cluster includes a representative conversion function and representative characteristics. For each cluster, the representative conversion function and the representative characteristics are associated with each other. A data set of a plurality of persons being measured belongs to a cluster. The representative conversion function can be obtained from a plurality of difference value vectors that belong to a cluster. The representative characteristics are obtained from a plurality of first ear canal transfer characteristics that belong to a cluster. The representative characteristics and the representative conversion function are in vector form with the same number of dimensions. The representative characteristics and the representative conversion function, and the first frequency characteristics and the difference value vector are in vector form with the same number of dimensions. Then the representative characteristics and the representative conversion function that correspond to each cluster are stored in the data storage unit 303 as a database.

It is sufficient that the data storage unit 303 store data of the clusters shown in FIG. 9 and the data storage unit 303 may not store the preset data shown in FIG. 8. To be specific, after the data storage unit 303 obtains the representative characteristics and the representative conversion function, the server device 300 may delete the first and second preset data and the like. Further, data enhancement can be easily performed as long as the data storage unit 303 holds the first and second preset data.

Next, processing of generating a filter based on the user data will be described. The receiving unit 301 receives the user data transmitted from the out-of-head localization device 100. The user data here is first frequency characteristics user-bim (which is described hereinafter as first ear canal transfer characteristics user-bim).

The comparison unit 302 compares the first ear canal transfer characteristics user-bim, which is the user data, with the representative characteristics. To be more specific, the comparison unit 302 calculates a similarity score for each cluster by comparing the user data with the representative characteristics of each cluster. A cluster with the highest similarity score is a similar cluster. The comparison unit 302 performs matching for all the clusters.

Hereinafter, one example of processing in the comparison unit 302 will be described. As described above, the user data includes the first ear canal transfer characteristics user-bim. Further, each cluster includes the representative characteristics (e.g., 1_bim) that correspond to the first ear canal transfer characteristics.

The comparison unit 302 calculates a correlation coefficient r between the first ear canal transfer characteristics user-bim and the representative characteristics (e.g., 1_bim). The comparison unit 302 calculates a Euclidean distance q between the first ear canal transfer characteristics user-bim and the representative characteristics (e.g., 1_bim).

The comparison unit 302 calculates a similarity score based on the correlation coefficient r and the Euclidean distance q. The smaller the value of the Euclidean distance q becomes, the shorter the distance becomes, indicating that they have more similar characteristics. The correlation coefficient r has a value between −1 and +1, and as this value becomes closer to +1, it means that they have more similar characteristics. Therefore, as the value of (1−r) becomes smaller, it means that their characteristics are more similar with each other.

The comparison unit 302 calculates a similarity score by calculating a weighted sum of two values (1−r) and q. The weight used for the calculation of the weighted sum can be set as appropriate. The comparison unit 302 then calculates a similarity score for each cluster. The comparison unit 302 sets the cluster with the highest similarity score as a similar cluster. In this manner, the similar cluster that is most similar to the user data is selected. Note that the comparison unit 302 may calculate a similarity score using only one of the distance between vectors and the correlation coefficient. Note that the similarity score may be calculated using cosine similarity (cosine distance), Mahalanobis' distance, Pearson correlation coefficient or the like instead of using the magnitudes of the correlation value and the distance vector (Euclidean distance).

The extraction unit 304 extracts the representative conversion function based on the comparison result in the comparison unit 302. Specifically, the extraction unit 304 reads out the representative conversion function (e.g., 1_CONV) included in the similar cluster from the data storage unit 303. The extraction unit 304 extracts the representative conversion function of the similar cluster similar to the first ear canal transfer characteristics of the user. The transmitting unit 306 transmits the representative conversion function to the out-of-head localization device 100.

Then the receiving unit 132 of the out-of-head localization device 100 shown in FIG. 5 receives a representative conversion function. As described above, the conversion unit 123 calculates the second ear canal transfer characteristics user-Stetho by applying the representative conversion function to the first ear canal transfer characteristics user-bim. For example, the conversion unit 123 adds the amplitude value of the representative conversion function to the amplitude value of the first ear canal transfer characteristics user-bim. That is, a sum of the amplitude value of the first ear canal transfer characteristics user-bim and the amplitude value of the representative conversion function for each frequency is the second ear canal transfer characteristics user-Stetho. It is therefore possible to obtain the frequency-amplitude characteristics of the second ear canal transfer characteristics. The inverse filter calculation unit 121 calculates inverse characteristics so as to cancel out the second ear canal transfer characteristics user-Stetho and performs inverse Fourier transform, to thereby obtain the inverse filter.

The out-of-head localization filter generation system 500 performs the above processing on each of the left and right first ear canal transfer characteristics userL-bim and userR-bim. According to this operation, the left and right inverse filters L_inv and R_inv are set. The similar cluster for the left first ear canal transfer characteristics userL-bim may be the same as or different from the similar cluster of the right first ear canal transfer characteristics userR-bim.

In this embodiment, the first ear canal transfer characteristics user-bim are measured using the microphone unit 62 embedded in the headphones 43. Then by applying the representative conversion function to the frequency characteristics of the first ear canal transfer characteristics, the second ear canal transfer characteristics user-Stetho of the user are obtained. According to this operation, it is possible to obtain an inverse filter that is suitable for a user by a simple measurement. It becomes possible to appropriately perform out-of-head localization.

There is no need for an operator other than a user to adjust the position of the microphone, the position of the headphones, and the like. It is possible to obtain an inverse filter by the measurement made by the user alone. With a user terminal such as a smartphone and headphones 43 including the microphone unit 62, measurement can be performed even in an environment other than a listening environment such as a listening room.

Further, the clustering unit 315 performs clustering based on the difference value vector between the first ear canal transfer characteristics and the second ear canal transfer characteristics obtained for the ear of the person being measured. Accordingly, a plurality of data sets can be appropriately clustered. Further, the representative characteristics calculation unit 319 calculates the representative characteristics for each cluster. By using the representative characteristics generated in view of data of the second ear canal transfer characteristics in addition to data of the first ear canal transfer characteristics, matching can be appropriately performed in a state in which the positional relation between the entrance of the ear canal whose position varies for each person and a built-in microphone is taken into account. Further, the representative characteristics and the representative conversion function are associated with each other for each cluster. The conversion unit 123 is able to convert the first ear canal transfer characteristics into the second ear canal transfer characteristics using a representative conversion function that is suitable for a user.

Further, representative characteristics are obtained for each cluster. The comparison unit 302 determines a similar cluster by comparing the user data with the representative characteristics. In this manner, there is no need to calculate similarity scores for all the data sets obtained in the pre-measurement. That is, the data set whose similarity score is calculated can be selected. Therefore, when data sets of a large number of persons being measured are stored in a database, it becomes possible to shorten the processing time.

Figure 10:
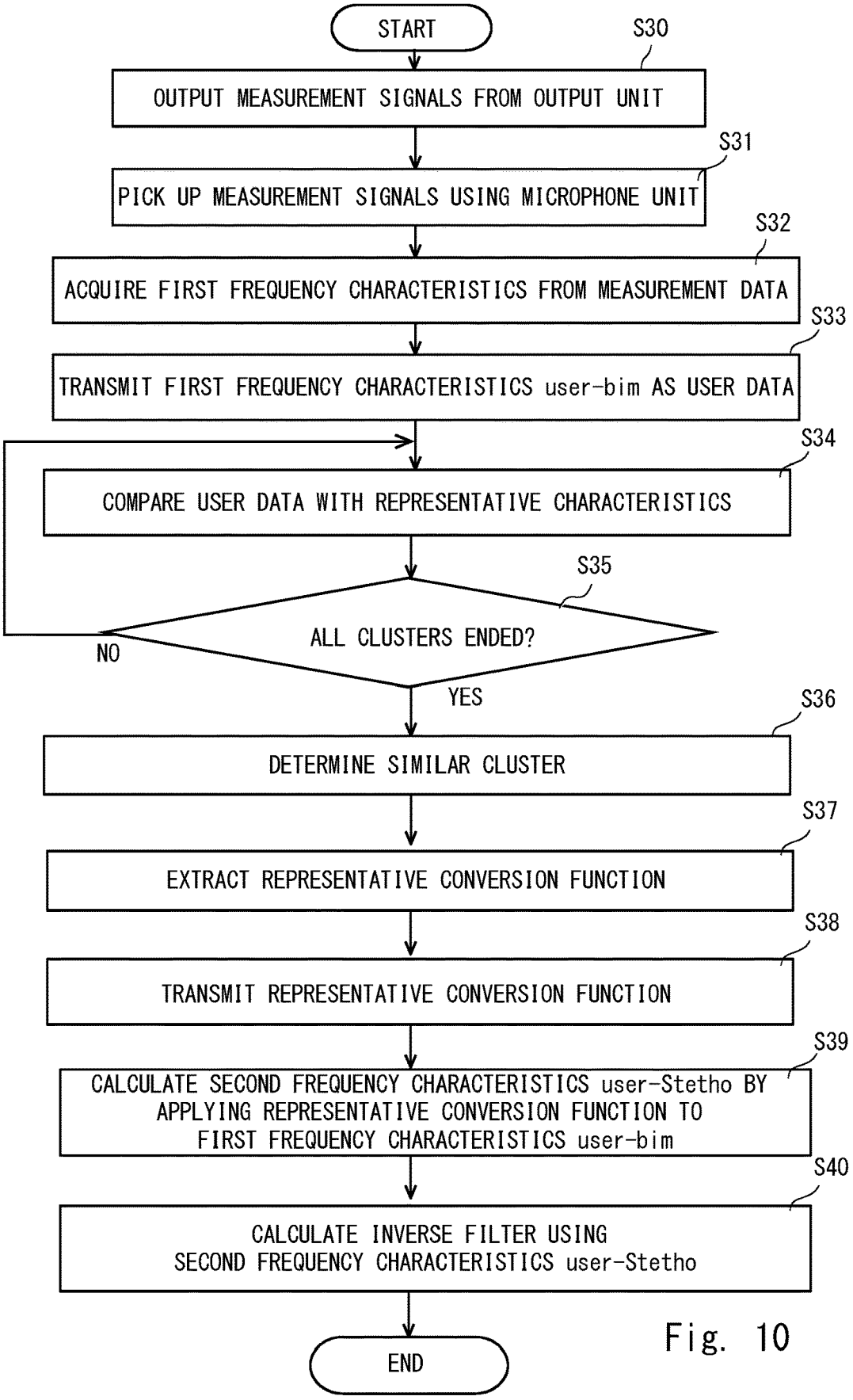
FIG. 10 is a flowchart showing an out-of-head localization filter generation method.

With reference to FIG. 10, one example of the out-of-head localization filter generation method according to this embodiment will be described. FIG. 10 is a flowchart showing a method of generating the inverse filter. Prior to performing processing shown in FIG. 10, the server device 300 classifies persons being measured into a plurality of clusters.

First, as shown in FIG. 5, the impulse response measurement unit 111 outputs measurement signals from the output unit of the headphones 43 (S30). The impulse response measurement unit 111 picks up the measurement signals using the microphone unit 62 (S31). The impulse response measurement unit 111 acquires the measurement data regarding the first ear canal transfer characteristics of the user U. The impulse response measurement unit 111 may perform synchronous addition processing.

Next, the frequency characteristics acquisition unit 112 acquires the first frequency characteristics user-bim from the measurement data (S32). The frequency characteristics acquisition unit 112 performs Fourier transform on the measurement data in the time domain, whereby frequency-amplitude characteristics and frequency-phase characteristics are obtained. The frequency-amplitude characteristics are the first frequency characteristics user-bim.

The transmitting unit 131 transmits, as the user data, the first frequency characteristics user-bim to the server device 300 (S33). Specifically, a set of amplitude values of the first frequency characteristics user-bim is transmitted as the user data. Note that, in the out-of-head localization device 100, the first ear canal transfer characteristics in the time domain may be transmitted by the server device 300. In this case, the frequency characteristics acquisition unit 312 performs Fourier transform on the first ear canal transfer characteristics of the user.

The comparison unit 302 compares the user data with the representative characteristics (S34). The comparison unit 302 compares the first frequency characteristics user-bim with the representative characteristics (e.g., 1-bim) of a cluster. A similarity score for one cluster is thus obtained.

The comparison unit 302 determines whether or not all the clusters have been ended (S35). When any one of the clusters has not been ended (NO in S35), the process returns to Step S34, where the comparison unit 302 compares the user data with the representative characteristics of the next cluster. When all the clusters have been ended (YES in S35), the comparison unit 302 determines the similar cluster (S36). That is, the cluster with the highest similarity score is determined to be a similar cluster.

The extraction unit 304 extracts a representative conversion function of the similar cluster based on the comparison result (S37). The transmitting unit 306 transmits the representative conversion function to the out-of-head localization device 100 (S38). The conversion unit 123 calculates the second frequency characteristics user-Stetho by applying the representative conversion function to the first frequency characteristics user-bim (S39).

The inverse filter calculation unit 121 calculates the inverse filter using the second frequency characteristics user-Stetho. The inverse filter calculation unit 121 calculates the inverse filter based on the second frequency characteristics user-Stetho (S40). The inverse filter so as to cancel out amplitude spectra of the second frequency characteristics user-Stetho is thus generated.

According to the above processing, it is possible to appropriately calculate an inverse filter. While the out-of-head localization device 100 calculates the inverse filter in the aforementioned description, a part of the processing for calculating the inverse filter may be executed in the server device 300. For example, the server device 300 may calculate the second frequency characteristics user-Stetho based on the first frequency characteristics user-bim and the representative conversion function. Then the out-of-head localization device 100 may generate the inverse filter from the second frequency characteristics user-Stetho received from the server device 300.

A part of the processing of the server device 300 may be performed in the out-of-head localization device 100. Alternatively, a device that is physically different from the out-of-head localization device 100, the measurement processor 201, and the server device 300 may perform a part of the above processing.

Modified Example 1

Figure 11:
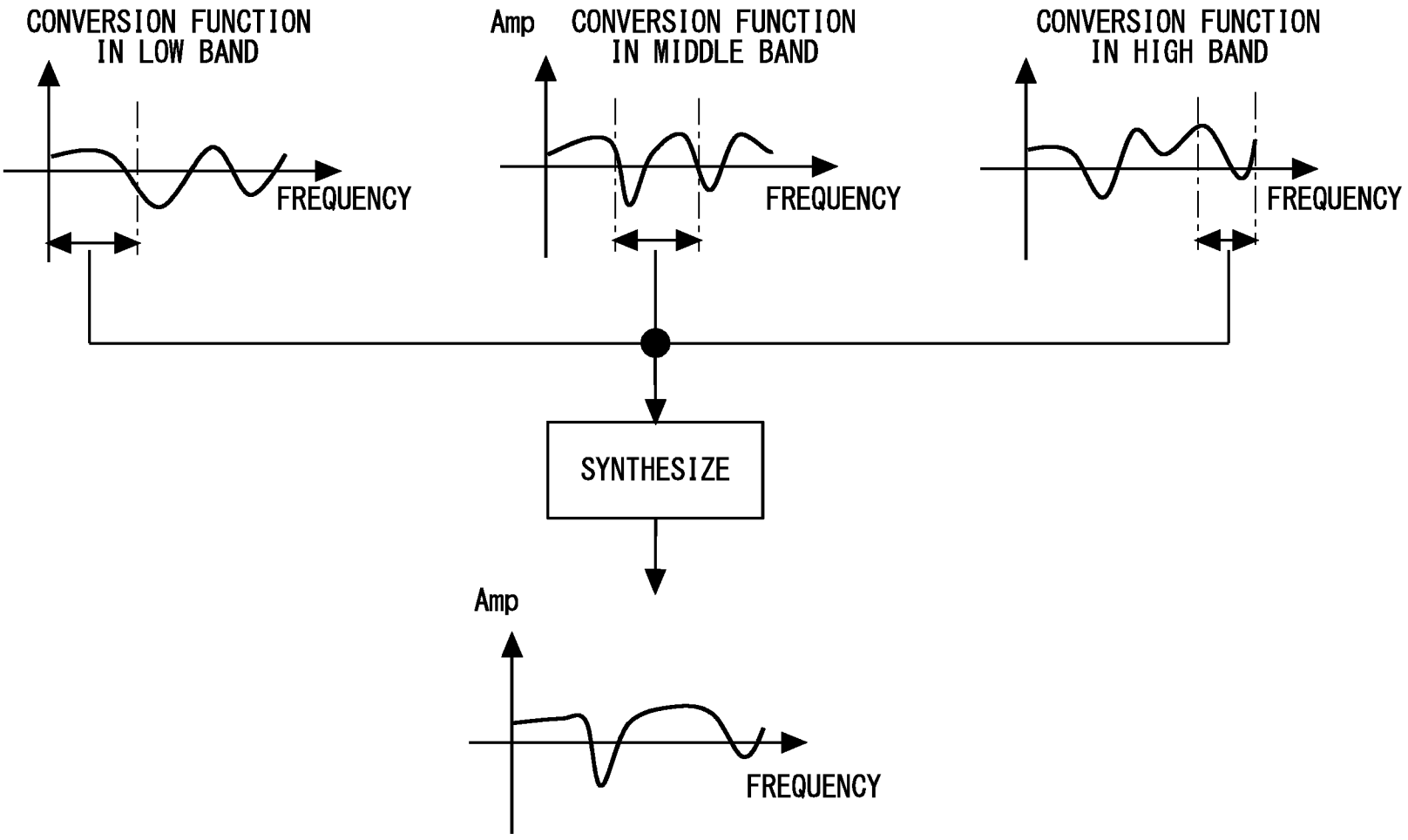
FIG. 11 is a view showing processing of synthesizing representative conversion functions for each band.

The clustering unit 315 may perform clustering in a divided manner for each band. For example, the server device 300 divides the first and second ear canal transfer characteristics into three bands, that is, a low band, a middle band, and a high band. The transform vector calculation unit 317 calculates a difference value vector for each band. FIG. 11 is a view showing processing for synthesizing representative conversion functions divided into three bands. In FIG. 11, the horizontal axis indicates a frequency and the vertical axis indicates an amplitude value. The representative conversion function calculation unit 318 calculates each of a representative conversion function in the low band, a representative conversion function in the middle band, and a representative conversion function in the high band based on a data set that belongs to each cluster.

Therefore, the server device 300 divides the first ear canal transfer characteristics of the person being measured into three bands. The server device 300 obtains first ear canal transfer characteristics in the low band, first ear canal transfer characteristics in the middle band, and first ear canal transfer characteristics in the high band. The server device 300 divides the second ear canal transfer characteristics of the person being measured into three bands. The server device 300 obtains second ear canal transfer characteristics in the low band, second ear canal transfer characteristics in the middle band, and second ear canal transfer characteristics in the high band. The transform vector calculation unit 317 calculates a difference value vector between the second ear canal transfer characteristics and the first ear canal transfer characteristics for each band. Accordingly, the transform vector calculation unit 317 is able to calculate the difference value vector for each band.

The clustering unit 315 performs clustering based on the difference value vector of each band. The clustering unit 315 divides a data set into a plurality of clusters based on the difference value vector in the low band. Likewise, the clustering unit 315 divides a data set into a plurality of clusters based on the difference value vector in the middle band. The clustering unit 315 divides a data set into a plurality of clusters based on the difference value vector in the high band.

The representative conversion function calculation unit 318 calculates a representative conversion function for each band. As described above, the representative conversion function is a set of representative values of a plurality of difference value vectors. Therefore, as shown in FIG. 11, a representative conversion function in the low band, a representative conversion function in the middle band, and a representative conversion function in the high band are acquired.

The representative characteristics calculation unit 319 calculates representative characteristics for each band. As described above, the representative characteristics are a set of representative values of a plurality of first ear canal transfer characteristics. The representative characteristics in the low band, the representative characteristics in the middle band, and the representative characteristics in the high band are acquired.

In the cluster in the low band, the representative characteristics in the low band and the representative conversion function in the low band are stored in association with each other. In the cluster in the middle band, the representative characteristics in the middle band and the representative conversion function in the middle band are stored in association with each other. In the cluster in the high band, representative characteristics in the high band and a representative conversion function in the high band are stored in association with each other.

The server device 300 divides the user data into three bands in the same manner. The comparison unit 302 compares the user data with the representative characteristics for each band. The comparison unit 302 determines a similar cluster for each band. The extraction unit 304 extracts the representative conversion functions of the similar clusters for the respective bands and synthesizes them. The extraction unit 304 connects the representative conversion function in the high band, that in the middle band, and that in the high band. According to this operation, the representative conversion functions in all the bands are obtained. The extraction unit 304 couples the amplitude values of the respective bands to generate the representative conversion function. The extraction unit 304 may couple the amplitude values where the boundaries between bands overlap each other by cross-fade or the like.

While the clustering unit 315 clusters first and second ear canal transfer characteristics in the aforementioned description, spatial acoustic transfer characteristics may be held in association with the preset data that belongs to each cluster. For example, the data set related to the left ear of the person being measured is associated with spatial acoustic transfer characteristics Hls and Hro related to the left ear. The data set related to the right ear of the person being measured is associated with the spatial acoustic transfer characteristics Hrs and Hlo related to the right ear. Further, the server device 300 that may calculate a representative value from a plurality of acoustic transfer characteristics that belong to each cluster and transmit representative spatial acoustic transfer characteristics transmits representative spatial acoustic transfer characteristics of a similar cluster to the out-of-head localization device 100. It is therefore possible to generate an out-of-head localization filter more simply.

While the clustering unit 315 performs clustering using a difference value vector as a feature quantity vector in the aforementioned description, the clustering unit 315 may perform clustering using data other than the difference value vector. For example, the first ear canal transfer characteristics or the second ear canal transfer characteristics may be added to the feature quantity vector. Further, while the independent microphone shown in FIG. 4 picks up the second ear canal transfer characteristics in the aforementioned description, the built-in microphone shown in FIG. 3 may acquire the second ear canal transfer characteristics. Specifically, the built-in microphone picks up the second ear canal transfer characteristics in a state in which the person 1 being measured wears the headphones in which a microphone is embedded shown in FIG. 3 and the independent microphone shown in FIG. 4. Further, the feature quantity may be a spatial transfer function itself between the first ear canal transfer characteristics and the second ear canal transfer characteristics.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as flexible disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

Although embodiments of the invention made by the present invention are described in the foregoing, the present invention is not restricted to the above-described embodiments, and various changes and modifications may be made without departing from the scope of the invention.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A processor comprising:

an output unit configured to be worn on a person being measured and output sounds to an ear of the person being measured;

a built-in microphone embedded in the output unit;

an independent microphone provided independently from the output unit;

a measurement processor unit configured to output a measurement signal to the output unit and measure a sound pickup signal output from the built-in microphone or the independent microphone;

a frequency characteristics acquisition unit configured to acquire each of frequency characteristics of first ear canal transfer characteristics acquired using the built-in microphone and frequency characteristics of second ear canal transfer characteristics acquired in a state in which the independent microphone is worn on the person being measured;

a conversion function calculation unit configured to calculate a conversion function between the frequency characteristics of the first ear canal transfer characteristics and the frequency characteristics of the second ear canal transfer characteristics;

a clustering unit configured to cluster a plurality of persons being measured based on conversion functions of the plurality of persons being measured;

a representative characteristics calculation unit configured to calculate representative characteristics for each cluster based on the plurality of first ear canal transfer characteristics that belong to each cluster; and a representative conversion function calculation unit configured to calculate a representative conversion function for each cluster based on the plurality of conversion functions that belong to each cluster.

2. The processor according to claim 1, further comprising:

a data storage unit configured to store first preset data related to the first ear canal transfer characteristics picked up by the built-in microphone embedded in the output unit and second preset data related to the second ear canal transfer characteristics acquired in the state in which the person being measured wears the independent microphone in association with each other, the data storage unit storing a plurality of first and second preset data acquired for the plurality of persons being measured;

a comparison unit configured to compare the first frequency characteristics with the representative characteristics; and an extraction unit configured to extract the representative conversion function based on a comparison result in the comparison unit.

3. The processor according to claim 2, further comprising:

a conversion unit configured to convert the first frequency characteristics into second frequency characteristics by applying the extracted representative conversion function to the first frequency characteristics; and an inverse filter calculation unit configured to calculate an inverse filter based on the second frequency characteristics.

4. The processor according to claim 1, wherein the clustering unit performs clustering for each of a plurality of bands.

5. An out-of-head localization filter generation method in a system, the system comprising:

an output unit configured to be worn on a user and output sounds to an ear of the user;

a built-in microphone embedded in the output unit;

a data storage unit configured to store first preset data related to first ear canal transfer characteristics picked up by the built-in microphone embedded in the output unit and second preset data related to second ear canal transfer characteristics acquired in a state in which a person being measured wears an independent microphone that is independent from the output unit in association with each other, the data storage unit storing a plurality of first and second preset data acquired for a plurality of persons being measured, wherein in the data storage unit, the first and second preset data are clustered based on a conversion function between the first ear canal transfer characteristics and the second ear canal transfer characteristics, representative characteristics are calculated for each of clusters based on a plurality of first ear canal transfer characteristics that belong to each cluster, a representative conversion function is calculated for each cluster based on the plurality of conversion functions that belong to each cluster, and the out-of-head localization filter generation method comprises:

an output step for outputting a measurement signal to each output unit worn on the user;

a signal acquisition step for acquiring a sound pickup signal when the measurement signal output from the output unit toward the user's ear is picked up by the built-in microphone worn on the ear of the user;

a first frequency characteristics acquisition step for converting the sound pickup signal into a frequency domain and acquiring first frequency characteristics;

a comparing step for comparing the first frequency characteristics with a plurality of representative characteristics;

an extraction step for extracting the representative conversion function based on a comparison result in the comparing step;

a second frequency characteristics calculation step for calculating second frequency characteristics by applying the extracted representative conversion function to the first frequency characteristics; and an inverse filter calculation step for calculating an inverse filter based on the second frequency characteristics.

6. A non-transitory computer readable medium storing a program for causing a computer to execute an out-of-head localization filter generation method, wherein the computer is able to access a data storage unit configured to store first preset data related to first ear canal transfer characteristics picked up by a built-in microphone embedded in an output unit and second preset data related to second ear canal transfer characteristics acquired in a state in which a person being measured wears an independent microphone that is independent from the output unit in association with each other, the data storage unit storing a plurality of first and second preset data acquired for a plurality of persons being measured, in the data storage unit, the first and second preset data are clustered based on a conversion function between the first ear canal transfer characteristics and the second ear canal transfer characteristics, representative characteristics are calculated for each of clusters based on a plurality of first ear canal transfer characteristics that belong to each cluster, a representative conversion function is calculated for each cluster based on the plurality of conversion functions that belong to each cluster, and the out-of-head localization filter generation method comprises:

an output step for outputting a measurement signal to each output unit worn on the user;

a signal acquisition step for acquiring a sound pickup signal when the measurement signal output from the output unit toward the user's ear is picked up by the built-in microphone worn on the ear of the user;

a first frequency characteristics acquisition step for converting the sound pickup signal into a frequency domain and acquiring first frequency characteristics;

a comparing step for comparing the first frequency characteristics with a plurality of representative characteristics;

an extraction step for extracting the representative conversion function based on a comparison result in the comparing step;

a second frequency characteristics calculation step for calculating second frequency characteristics by applying the extracted representative conversion function to the first frequency characteristics; and an inverse filter calculation step for calculating an inverse filter based on the second frequency characteristics.

* * * * *